US005805010A

United States Patent [19]

Wu

[11] Patent Number: 5,805,010

[45] Date of Patent: Sep. 8, 1998

[54] LOW-CURRENT SOURCE CIRCUIT

[75] Inventor: Chuan-Yu Wu, Keelung, Taiwan

[73] Assignee: Powerchip Semiconductor Corp., Hsinchu, Taiwan

[21] Appl. No.: 759,783

[22] Filed: Dec. 3, 1996

[51] Int. Cl.[6] ..... G05F 1/10

[52] U.S. Cl. ..... 327/538; 327/530; 327/543

[58] Field of Search ..... 323/312, 315, 323/316; 327/530, 538, 542, 543

[56] References Cited

U.S. PATENT DOCUMENTS 5,017,858 5/1991 Hayashi ..... 323/316
5,530,397 6/1996 Nakai et al. ..... 327/545

*Primary Examiner*—Timothy P. Callahan
*Assistant Examiner*—Jeffrey Zweizig
*Attorney, Agent, or Firm*—Ladas & Parry

[57] ABSTRACT

A low-current source circuit for generating a constant current and a reference voltage from a fluctuating voltage source is disclosed. A resistive circuit is electrically connected to the voltage source for determining amount of the constant current. A charging circuit is electrically connected to a second lead of the resistive circuit and the voltage source for supporting a charging path for the voltage source. A current output circuit is electrically connected to the second lead of the resistive circuit for outputting the constant current. A stabilizing circuit is electrically connected between the second lead of the resistive circuit and a control lead of the current output circuit for stabilizing the current output circuit. A reference voltage circuit is electrically connected to an output lead and the control lead of the current output circuit for generating the reference voltage.

19 Claims, 6 Drawing Sheets

LOW-CURRENT SOURCE CIRCUIT

CROSS REFERENCE TO RELATED APPLICATION

This invention is related to copending U.S. patent application Ser. No. 08/756,792 filed Nov. 26, 1996 entitled "Self-biased Voltage-regulated Current Source" assigned to the same assignee as the present application and incorporated herein by reference in its entirety.

BACKGROUND OF THE INVENTION

1. Field of the Invention

The present invention relates to a current source circuit, and particularly to a low-current source circuit for generating a constant current and a reference voltage with minimized idle state.

2. Description of the Prior Art

A stable current source is frequently used in an electrical circuit, for example, to bias a transistor, supply a constant current source or a reference voltage. A low current characteristic is very desirable for modern integrated circuits, where low power consumption is often a design requirement. However, a low current characteristic often results in a long circuit response time, an undesirable characteristic since it destabilizes or even causes malfunctions to occur in a circuit supplied by the circuit source whenever the value of the output current from the current source fluctuates.

A conventional current source, such as the reference voltage generator used in a voltage down-converter disclosed in IEEE Journal of Solid-State Circuits, VOL. 27, NO. 7, Jul. 1992, entitled "*A 34-ns 16-Mb DRAM with Controllable Voltage Down-Converter*" by Hideto Hidaka et. al., is depicted in FIG. 1. A node $M_2$ is charged through a p-type metal-oxide-semiconductor (PMOS) transistor $Q_1$, which is powered by a voltage source $V_{CC}$. A gate 10 and a source 12 of the PMOS transistor $Q_1$ is connected in parallel with a resistor 11, whose resistance R is conventionally programmed by a fuse process. Another PMOS transistor $Q_2$ is used for outputting a constant current I. A reference current $I_1$ flowing through an n-type metal-oxide-semiconductor (NMOS) transistor $Q_3$ is further used for determining the constant current I flowing from drain 14 of the PMOS transistor $Q_2$ to drain 16 of a NMOS transistor $Q_4$, and a reference voltage is thus generated at node 18. The amount of the output current I is determined by:

$$I=V_{thp}/R \quad [1]$$

where $V_{thp}$ is the threshold voltage of a MOS transistor and where R is the resistance of the resistor 11.

The potential at node $M_1$ is therefore determined by the following equation:

$$V_{M1}=V_{CC}-V_{thp}$$

The PMOS transistor $Q_2$, which has a high output resistance, acts as a current output stage, and the potential at node $M_2$ is approximated by the following equation if the current I is small enough:

$$V_{M2}=V_{M1}-V_{thp}=V_{CC}-2\ V_{thp}$$

When the currents I and $I_1$ approach zero, an idle state, also referred to as a shutdown mode, is reached, and the potential at node $M_1$ is:

$$V_{M1}=V_{CC}$$

The potential at node $M_2$ is:

$$V_{M2}<V_{CC}-V_{thp}$$

As the charging at node $M_2$ is faster than the charging at node $M_1$ due to a fluctuation voltage bump $V_{bump}$, the voltage at node $M_2$ increases above $(V_{CC}-V_{thp})$, forcing the whole circuit into the idle state. This idle state can not be eliminated when the difference voltage between the node $M_1$ and node $M_2$ is less than the threshold voltage of a MOS transistor even the voltage at $M_2$ is less than $(V_{CC}-V_{thp})$. Subsequent charging at node $M_1$ through resistor 11 and discharging at node $M_2$ is needed to recover from the idle state. According to the equation 1, a large resistance R is required for a low-current source circuit, further lengthening the idle time $t_{off}$ which is proportional to the resistance R.

FIGS. 2A to 2C are the timing diagrams depicting the difference voltage and the output current in response to a voltage bump. Furthermore, the difference voltage and the output current increase as a voltage drop occurs in the source, which is depicted in FIGS. 3A to 3C. From the foregoing discussion, a practical low-current source circuit with minimized idle state cannot be achieved using the conventional circuit structure.

SUMMARY OF THE INVENTION

In accordance with the present invention, a low-current source circuit for generating a constant current and a reference voltage is disclosed. In a preferred embodiment, the source circuit is powered by a voltage source which supplies a source voltage which may fluctuate. A resistive circuit, for example a resistor, is electrically connected to the voltage source at a first lead of the resistive circuit for determining amount of the constant current, and a charging circuit is electrically connected to a second lead of the resistive circuit and the voltage source for supporting a charging path for the voltage source. A current output circuit is further electrically connected to the second lead of the resistive circuit for outputting the constant current. A stabilizing circuit is electrically connected between the second lead of the resistive circuit and a control lead of the current output circuit for stabilizing the current output circuit. Moreover, a reference voltage circuit electrically connected to an output lead and the control lead of the current output circuit is used for generating the reference voltage and a feedback reference current for producing the constant current. A driving circuit electrically connected among the control lead of the current output means, the second lead of the resistive circuit and an output lead of the charging circuit is used for driving the current output circuit, and preventing the charging circuit from directly charging the control lead of the current output circuit.

DESCRIPTION OF THE PREFERRED EMBODIMENT

Figure 4:
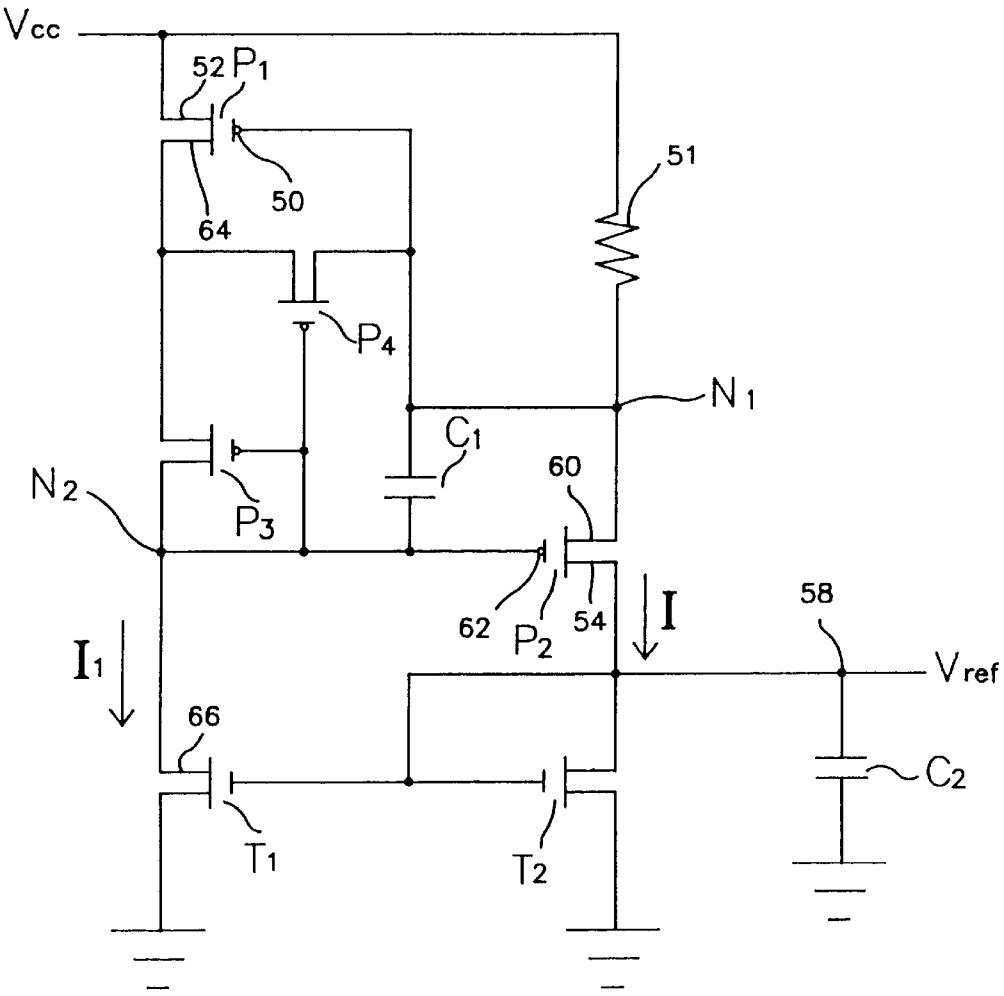
FIG. 4 shows one embodiment of the present invention.

FIG. 4 shows a preferred embodiment of the present invention. A node $N_2$ is charged through a PMOS transistor $P_1$, which is powered by a voltage source $V_{CC}$. As those skilled in the art appreciate, voltage $V_{CC}$ is apt to fluctuate. The gate 50 and the source 52 of PMOS transistor $P_1$ is connected in parallel with a resistor 51, whose resistance R is conventionally programmed, for example, by a fuse process. Another PMOS transistor $P_2$ is connected to the resistor 51 at its source 60 and is used to output a constant current I flowing via its drain 54. A reference current $I_1$, which acts as a feedback reference current, flows through an NMOS transistor $T_1$ and is further used to bias PMOS $P_2$ for determining the constant current I flowing via the drain 54 of PMOS transistor $P_2$ to a node 58, and a reference voltage $V_{ref}$ is thus generated at the node 58.

A capacitor $C_1$ is connected in parallel with source 60 and gate 62 of PMOS transistor $P_2$ and is used to stabilize the constant current output I by supplying current needed to reduce the voltage difference between the source 60 and the gate 62 of transistor $P_2$ since the potential changes at node $N_1$ and node $N_2$ are not proportional.

A PMOS transistor $P_3$ and a PMOS transistor $P_4$ are preferably connected to the drain 64 and gate 50 of transistor $P_1$, node $N_1$ and node $N_2$ in the manner shown in FIG. 4. These two transistors are used to drive transistors $P_1$ and $P_2$, thereby preventing transistor $P_1$ from directly charging gate 62 of transistor $P_2$, and thus reducing nonproportional potential changes at the source 60 and gate 62 of transistor $P_2$.

A capacitor $C_2$ is preferably added between node 58 and earth to maintain the reference voltage $V_{ref}$. Capacitor $C_2$ together with the transistors $T_1$ and a transistor $T_2$ form a feedback circuit, wherein a current flowing through into the drain 66 of transistor $T_1$ is defined as a reference current $I_1$. The capacitance of capacitor $C_2$ is chosen to turn on the transistor $P_2$ before the reference voltage $V_{ref}$ decreases to the threshold voltage of a MOS transistor, thereby inhibiting the idle state.

According to the circuit structure described above, the reference current $I_1$ is determined by the following equation:

$$I_1 = I^* N_{mirror} \quad [2]$$

where $N_{mirror}$=Beta of transistor $T_1$/Beta of transistor $T_2$

The constant current output I is:

$$I = (V_{thp}/R)/(1+feedback) \quad [3]$$

where Feedback=$(N_{mirror}/\text{Beta}(P_3) - 1/\text{Beta}(P_2))^*\text{Beta}(P_4)$ According to the above equations 2 and 3, the resistance R required to attain the same constant current output I is therefore less than that of the conventional current circuit if a comparison is made equation [1].

Figure 1:
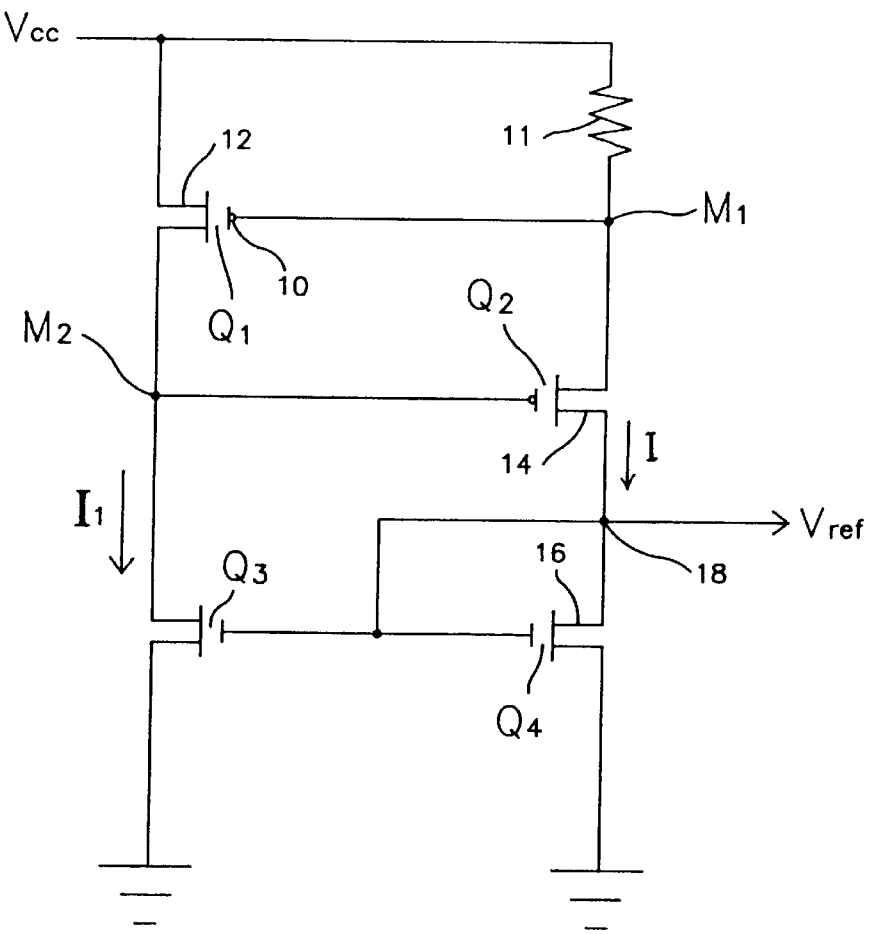
FIG. 1 (Prior Art)
FIG. 1 shows a conventional current source circuit.
Figure 2C:
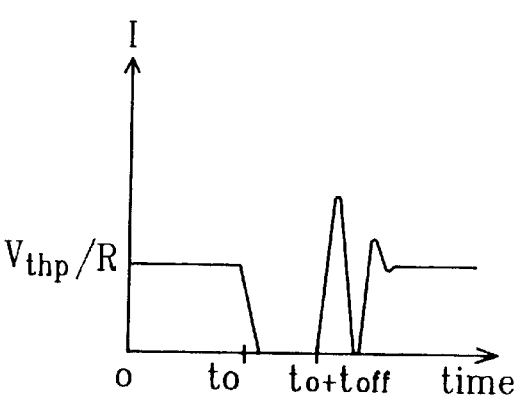
FIG.2C (Prior Art)
FIGS. 2A to 2C are timing diagrams depicting the difference voltage between nodes $M_1$ and $M_2$, and an output current after a bump voltage $V_{bump}$ occurs in the voltage source.
Figure 2B:
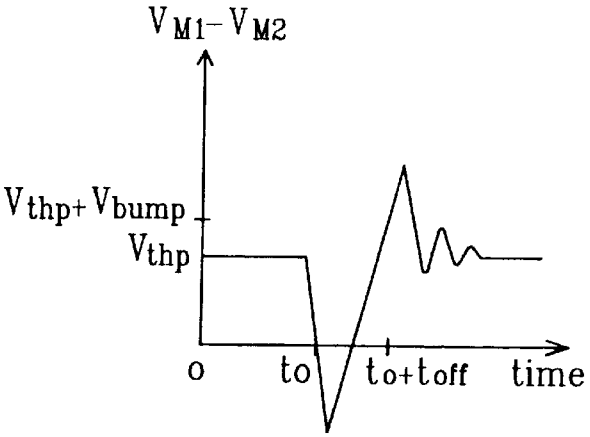
FIG.2B (Prior Art)
Figure 2A:
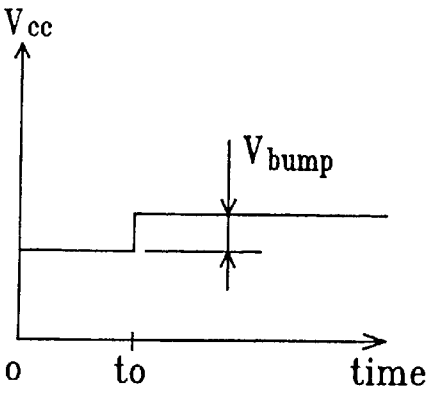
FIG.2A (Prior Art)
Figure 3A:
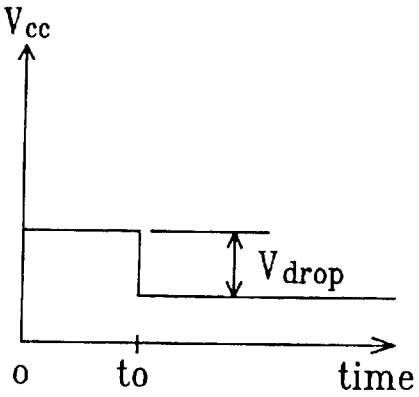
FIG.3A (Prior Art)
FIGS. 3A to 3C are timing diagrams depicting the difference voltage between nodes $M_1$ and $M_2$, and an output current after a voltage drop $V_{drop}$ occurs in the voltage source.
Figure 3B:
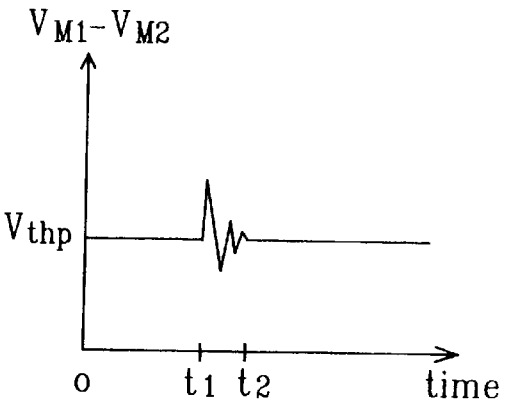
FIG.3B (Prior Art)
Figure 3C:
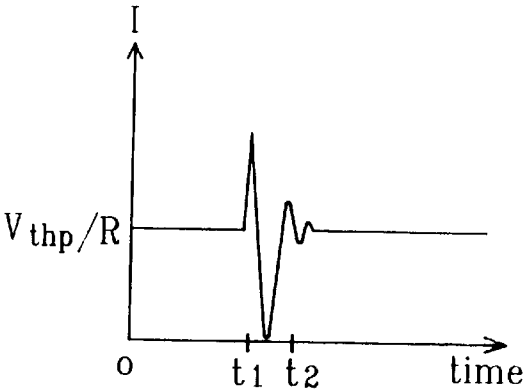
FIG.3C (Prior Art)
Figures 5A, 5B, 5C:
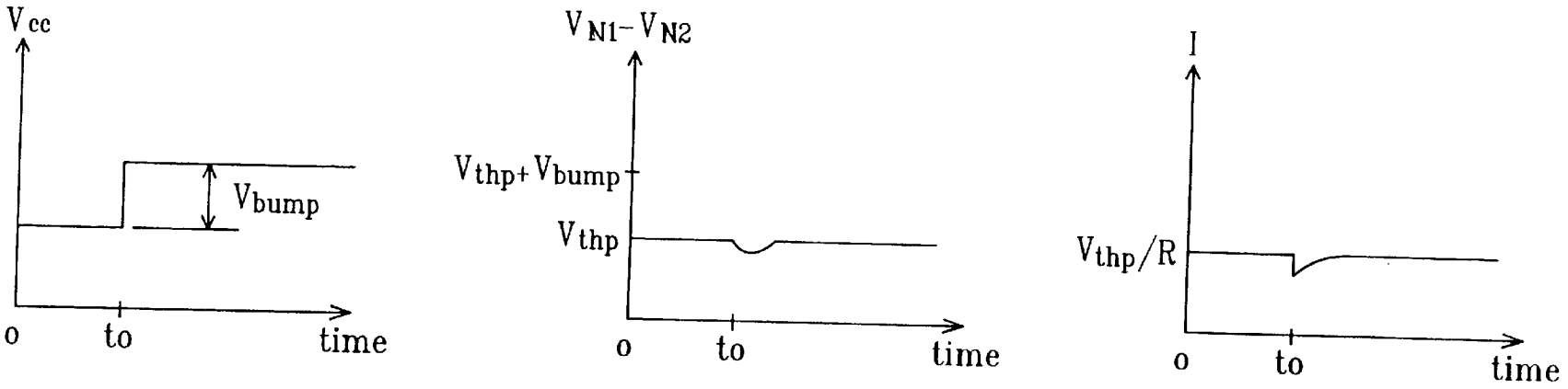
FIGS. 5A to 5C are timing diagrams depicting the difference voltage between nodes $N_1$ and $N_2$, and the output current after a voltage bump $V_{bump}$ occurs in the voltage source.
Figure 6A:
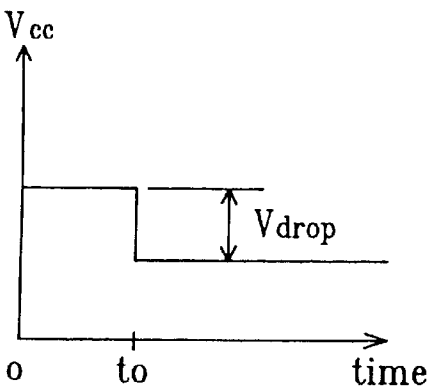
FIGS. 6A to 6C are timing diagrams depicting the difference voltage between nodes $N_1$ and $N_2$, and the output current after a voltage drop $V_{drop}$ occurs in the voltage source.
Figure 6B:
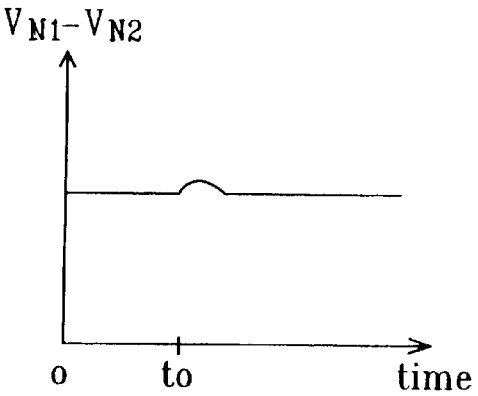
Figure 6C:
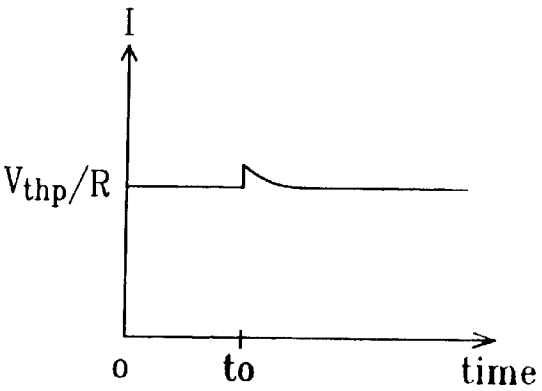

Comparing FIGS. 2A–2C with FIGS. 5A–5C and comparing FIGS. 3A–3C with FIGS. 6A–6C show the present invention yields better results than does the conventional circuit when a voltage bump occurs in the source voltage and when a voltage drop occurs in the source voltage. Thus a more stable current output I is provided by the present invention compared to the conventional circuit.

Although specific embodiments have been illustrated and described it will be obvious to those skilled in the art that various modification may be made without departing from the spirit which is intended to be limited solely by the appended claims.

What is claimed is:

1. A low-current source circuit for generating a constant current and a reference voltage, said low-current source circuit comprising:

a voltage source for supplying a voltage for said low-current source circuit, the potential of said voltage source fluctuating;

a resistive circuit electrically connected to said voltage source at a first lead of said resistive circuit;

charging means electrically connected to a second lead of said resistive circuit and said voltage source for supporting a charging path for said voltage source;

current output means electrically connected to the second lead of said resistive circuit for outputting the constant current;

means electrically connected between the second lead of said resistive circuit and a control lead of said current output means for stabilizing said current output means; and reference voltage means electrically connected to an output lead and the control lead of said current output means for generating the reference voltage, said reference voltage means generating a feedback reference current for producing the constant current.

2. The low-current source circuit according to claim 1, further comprising means electrically connected among the control lead of said current output means, the second lead of said resistive circuit and an output lead of said charging means for driving said current output means, said driving means preventing said charging means from directly charging the control lead of said current output means.

3. The low-current source circuit according to claim 1, further comprising means electrically connected between the output lead of said current output means and earth for maintaining the reference voltage.

4. The low-current source circuit according to claim 3, wherein said maintaining means comprises a capacitor electrically connected to the output lead of said current output means.

5. The low-current source circuit according to claim 1, wherein said resistive circuit comprises a resistor.

6. The low-current source circuit according to claim 1, wherein said charging means comprises a first transistor, a gate of said first transistor being connected to the second lead of said resistive circuit, a source of said first transistor being connected to said voltage source, and a drain of said first transistor being connected to said driving means.

7. The low-current source circuit according to claim 6, wherein said current output means comprises a second transistor, a source of said second transistor being connected to the second lead of said resistive circuit, a drain of said second transistor outputting the constant current.

8. The low-current source circuit according to claim 7, wherein said stabilizing means comprises a first capacitor, two leads of said stabilizing capacitor being respectively connected to the source and a gate of said second transistor.

9. The low-current source circuit according to claim 8, wherein said driving means comprises a third transistor for driving the gate of said second transistor, and a fourth transistor for driving the source of said second transistor, such that potentials of the gate and the source of said second transistor fluctuate simultaneously, thereby stabilizing the constant current through said current output means.

10. The low-current source circuit according to claim 9, wherein said reference voltage means comprises a fifth transistor for generating the feedback reference current, and a sixth transistor for generating the reference voltage.

11. A low-current source circuit for generating a constant current and a reference voltage, said low-current source circuit comprising:

a voltage source for supplying a voltage for said low-current source circuit, potential of said voltage source, in use, normally fluctuating;

a resistive circuit electrically connected to said voltage source at a first lead of said resistive circuit for determining amount of the constant current;

charging means electrically connected to a second lead of said resistive circuit and said voltage source for supporting a charging path for said voltage source;

current output means electrically connected to the second lead of said resistive circuit for outputting the constant current;

means electrically connected between the second lead of said resistive circuit and a control lead of said current output means for stabilizing said current output means;

reference voltage means electrically connected to an output lead and the control lead of said current output means for generating the reference voltage, said reference voltage means generating a feedback reference current for producing the constant current; and means electrically connected among the control lead of said current output means, the second lead of said resistive circuit and an output lead of said charging means for driving said current output means, said driving means preventing said charging means from directly charging the control lead of said current output means.

12. The low-current source circuit according to claim 11, further comprising means electrically connected between the output lead of said current output means and earth for maintaining the reference voltage.

13. The low-current source circuit according to claim 11, wherein said resistive circuit comprises a resistor.

14. The low-current source circuit according to claim 11, wherein said charging means comprises a transistor, a gate of said transistor being connected to the second lead of said resistive circuit, a source of said transistor being connected to said voltage source, and a drain of said transistor being connected to said driving means.

15. The low-current source circuit according to claim 11, wherein said current output means comprises a transistor, a source of said transistor being connected to the second lead of said resistive circuit, a drain of said transistor outputting the constant current.

16. The low-current source circuit according to claim 15, wherein said stabilizing means comprises a capacitor, two leads of said stabilizing means being respectively connected to the source and a gate of said transistor.

17. The low-current source circuit according to claim 16, wherein said driving means comprises another transistor for driving the gate of the first-mentioned transistor, and a yet another transistor for driving the source of said first-mentioned transistor, such that potentials of the gate and the source of said first-mentioned transistor fluctuate simultaneously, thereby stabilizing the constant current through said current output means.

18. The low-current source circuit according to claim 11, wherein said reference voltage means comprises a transistor for generating the feedback reference current, and another transistor for generating the reference voltage.

19. The low-current source circuit according to claim 12, wherein said maintaining means comprises a capacitor electrically connected to the output lead of said current output means.

* * * * *